US008517691B2

(12) United States Patent
Talbot et al.

(10) Patent No.: US 8,517,691 B2
(45) Date of Patent: Aug. 27, 2013

(54) APPARATUS/METHOD FOR TEMPERATURE CONTROLLED METHANOL INJECTION IN OIL AND GAS PRODUCTION STREAMS

(76) Inventors: Clint J. Talbot, Beaumont, TX (US); Michael D. Martindale, Beaumont, TX (US); Dean A. Talbot, Beaumont, TX (US)

( * ) Notice: Subject to any disclaimer, the term of this patent is extended or adjusted under 35 U.S.C. 154(b) by 433 days.

(21) Appl. No.: 12/807,576

(22) Filed: Sep. 9, 2010

(65) Prior Publication Data

US 2011/0085916 A1 Apr. 14, 2011

Related U.S. Application Data

(60) Provisional application No. 61/278,895, filed on Oct. 13, 2009.

(51) Int. Cl.
*E21B 29/02* (2006.01)

(52) U.S. Cl.
USPC ..... 417/14; 166/64; 166/90.1; 166/310

(58) Field of Classification Search
USPC ..... 417/14, 375, 392, 393; 166/64, 166/90.1, 310
See application file for complete search history.

(56) References Cited

U.S. PATENT DOCUMENTS 3,855,865 A * 12/1974 Kishimoto et al. ..... 60/512
5,188,178 A * 2/1993 Noyes ..... 166/310
6,196,246 B1 * 3/2001 Folsom ..... 137/2
6,981,848 B1 * 1/2006 Cessac ..... 417/14

* cited by examiner

*Primary Examiner* — Charles Freay
*Assistant Examiner* — Patrick Hamo
(74) *Attorney, Agent, or Firm* — Sue Z. Shaper

(57) ABSTRACT

An automatically controlled methanol injection system for oil and gas production streams including an electric methanol injection pump and a temperature sensor and switch, the sensor and switch adapted to automatically adjust the injection of methanol as a function of sensed temperature.

15 Claims, 3 Drawing Sheets

APPARATUS/METHOD FOR TEMPERATURE CONTROLLED METHANOL INJECTION IN OIL AND GAS PRODUCTION STREAMS

The instant application is related to and claims priority to provisional application 61/278,895, filed Oct. 13, 2009, entitled Apparatus/Method for Methanol Injection in Oil and Gas Production Streams, inventor Clint J. Talbot. The above referenced application Ser. No. 61/278,895 is herein and hereby incorporated by reference in its entirety, especially its table's.

FIELD OF THE INVENTION

The invention lies in the field of methanol injection systems for oil and gas production streams, and in particular, is applicable for remotely located methanol injection systems.

BACKGROUND OF THE INVENTION

Natural gas wells typically produce a mixture of natural gas, hydrocarbon condensate and water. There are a number of points in the production process where high pressure drops occur, resulting in a corresponding temperature drop caused by thermal expansion (Charles' Law). Freezing of the water and/or hydrocarbon condensate occurs when the thermal expansion temperature drop is coupled with low ambient temperatures, causing disruption of the well production. Furthermore, crude oil can be a liquid with relatively high viscosity that is inversely proportional to temperature. As ambient temperature drops below ~50° F., the viscosity of produced crude oil can rise to a point where the flow properties of the crude become problematical. To combat these problems producers originally brought in line heaters for the winter season. Because of safety concerns, producers subsequently switched to pumps set up in the winter season to inject methanol into the production streams, typically gas-powered pneumatic injection pumps.

A typical methanol practice today for remote and largely unmanned production locations is to turn on a pneumatic methanol injection pump at the onset of a "winter season." The pump runs continuously during the defined "winter season." The "winter season" is defined by experience at the well, selecting an initial date when ambient temperature may first be expected to dip below a selected temperature limit and selecting a terminal date when experience indicates that the temperature will not drop below the limit until the next season. The dates for a "winter season" will be a function of the geographic location of the remote facility and factors at the production location. Reliably defining the "winter season" is a duty for experienced operators in the field.

The temperature limit for defining the "winter season" is selected depending upon the well, the production stream and possibly a variety of other factors, in order to avoid freezing and/or poor flow. Such selected ambient temperature limit typically occurs within the range of 40° F. to 60° F.

Conservative temperature limits are usually selected for defining the onset of the "winter season" and for defining the end of the "winter season" because errors are costly. Because errors are costly, methanol injection in remote oil and gas production locations demands a high level of reliability. The cost for a day's lost production of natural gas, due to nonflow in a line, may be estimated to average about $500 per day.

Pneumatic chemical injection pumps are relatively inexpensive and historically favored, typically running around $500 to $700. Pneumatic pumps have a well established track record for high reliability. For low cost and high reliability reasons, remotely located methanol injection pumps have been traditionally powered pneumatically, the pneumatic motive force being reliably provided by the gas or fluid flowing through the production stream.

Environmental influences led to the development of solar rechargeable battery powered chemical injection pumps for certain chemical operations in remote locations, as "solar pumps" do not vent gas. However, solar pumps are expensive, running about 4 to 5 times the cost of a pneumatic pump, or around $2,500, and have reliability issues. There is doubt as to whether solar power would be able to provide an adequately charged battery 100% of the time.

As a result of reliability issues and high cost, solar-powered injection pumps have not enjoyed large use for methanol injection applications. Methanol injection requires high reliability. The very day a solar powered injection pump is most likely to be inoperative, the short, lowlight, cloudy winter day, coincides with the day that methanol injection is likely to be the most important. Although additional batteries could be added to a solar pump, they would almost double the cost again.

The instant invention arose based upon a surprising discovery: a surprisingly high, an unexpectedly high, amount of methanol, and thus money, is wasted by leaving a methanol injection pump running continuously "on" for a "winter season." This fact appears true over more or less the full range of particular temperature limits that might be selected to define a "winter season." A study by the instant inventors documented this surprising cost of the unnecessary expenditure of methanol. The extent of the loss had not been disclosed or documented by the industry prior to the inventor's study.

The Study

As discussed above, there is a variety of ambient temperature limits which might be selected to define a "winter season" for a site, below which temperature it is determined that methanol should be injected into a particular flow in a pipeline in order to avoid freezing or unacceptably low viscosity of the fluid in the pipeline. The particular ambient temperature limit selected typically varies between 40° F. to 60° F.

Given ambient temperature limits within the 40° F. to 60° F. range, the inventors studied the temperature variation, at a typical production location, for a "winter season." The conclusion was that a temperature controlled injection pump would save significant methanol and money. As documented for a range of ambient temperature limits, surprising levels of methanol would be saved, which translates into significant cost savings.

The Savings

In the study hourly temperature data was collected for a year. The year selected was 2008. As a significant volume of potential users are located in northern Texas, so weather station 10076 located at Dallas Love Field airport was the source of data. See the attached 259 pages of data in Table I of the provisional application, incorporated herein by reference. The data was analyzed based on two hypothetically selected "winter seasons": October 15 through April 15 and November 15 through March 15, both based on the data and both giving the hypothetical operator the benefit of hindsight, e.g. no mistake of freezing the pipe. The data was compared with three potential trigger temperatures, or "setpoints".

The run time results, summarized, of a continuous on/continuous off operation versus a "setpoint" operation, assuming an ambient temperature trigger, were as follows:

| Setpoint | Continuous On or Off (No set point) | 60° F. | 50° F. | 40° F. |
|---|---|---|---|---|
| Run time | November-March (2928 total hours) (100% of time) | 2202 hours (75%) | 1459 hours (50%) | 765 hours (26%) |
| Run time | October-April (4416 total hours) (100% of time) | 2698 hours (61%) | 1548 hours (35%) | 769 hours (17%) |

The results of analyzing the run time data surprisingly showed that a significant percentage of pump run time could be eliminated (as much as 83%, based on a 40° F. setpoint for the October through April scenario) with the application of an ambient temperature switch control. Approximately 40% of run time could be eliminated with a conservative 60° F. setting for the October through April approach. Furthermore, errors in the actual selection of the beginning or the ending of the "winter season" could be avoided.

To illustrate the savings in dollar amounts, recent methanol spot prices were ~$0.80/gallon for bulk contracts. Because chemical injection owners buy from local distributors in small (<100 gallon) quantities, they pay a significant mark-up. Recent prices are ~$4.00/gallon. Based on a recent article on ICIS.com, attached as Table II to the provisional application incorporated by reference, prices are expected to rise. The annual methanol consumption projections with and without the invention, based on ten gallons per day usage, were as follows:

| Setpoint | 60° F. | 50° F. | 40° F. |
|---|---|---|---|
| Traditional method: November-March | | $4880 | |
| With invention: November-March | $3670 | $2430 | $1275 |
| Traditional method: October-April | | $7360 | |
| With invention: October-April | $4495 | $2580 | $1280 |

The collected and analyzed data of the above initial study show that as much as $6080 annual savings in methanol (based on a 40° F. setpoint for the October through April scenario) could be realized by applying a simple on/off control. Approximately $3,000 per year could be saved using a conservative 60° set point, October-April.

DEVELOPMENT OF THE INVENTION

Given the motivation provided by the above study and the surprising results, the instant inventors considered temperature control systems for a methanol injection pump. Considering first the historically popular and reliable pneumatic pump, the inventors determined that design requirements to effect temperature control appeared complex, unwieldy and might possibly raise new reliability issues. The inventors therefore considered an electric pump, not the common pump used for methanol injection, in particular for an injection pump that could, if necessary, operate at remote, largely unmanned locations. The inventors thus considered a solar-powered electric pump. The historic drawbacks of the high cost and questionable reliability were temporarily put aside.

The cost concern, it turns out, was tangentially addressed by the study. Computations indicate that the high cost of a solar powered methanol injection pump could likely be recovered, in the form of saved methanol, within one year. In such scenario, even enhanced battery power for a solar rechargeable pump could be cost justified. In regard to reliability, a "temperature controlled solar injection pump" could produce a synergistic advantage. Again, this was tangentially addressed by the study. The study showed that temperature control should cause a pump to run only about 50% of the time. Only about 50% of the recharge capability would be required vis-à-vis a pump set continuously "on." Thus, reliability of a solar battery system would be enhanced by a temperature controller, important for the methanol context. Furthermore, solar pump lifetime, an additional cost concern, should be doubled for a temperature controlled methanol injection application, where the pump only runs 50% of the "winter season."

As a first test, the inventors produced and sold a solar powered chemical injection pump for a winter season, to document its reliability. A history of sales of over 100 such pumps demonstrated to the inventors that the solar pump could be sufficiently reliable in a temperature controlled methanol context. The inventors, then, successfully combined a temperature control system with an electric injection pump, including solar powered. The price of the solar-powered pump with temperature control ran ~$3000. This cost could likely be recovered through saved methanol in one season.

A subsequent patent search discovered only one patent reference (U.S. Pat. No. 6,981,848, Cessac, filed on Feb. 29, 1996) which taught turning off a methanol injection pump in accordance with sensed temperature and a temperature setpoint, to save methanol. This was pneumatic pump device. The patent explicitly teaches a temperature controller applied to a pneumatic injection pump, for cost and reliability reasons for methanol injection applications. The inventors know of no corresponding product on the market.

Specifically, Cessac teaches a temperature sensor activating a replaceable-battery powered control motor. The control motor turns a cam which opens and closes a valve in the gas line that supplies the motive gas to power the pneumatic pump. Advantages recited by Cessac were: "relatively low cost of a system for reliably injecting." Col 3 lines 1-3. Cessac recognized at least one drawback to his invention. Repeatedly having to change a replaceable-battery at a remote site could be such "an aggravation" that many operators would rather adopt a six month on, six months off approach. To alleviate the drawback, Cessac proposed a spread of 8° F. between a low "on setpoint," and a high "off setpoint" to lower power consumption. The spread, however, results in waste a of methanol and does not eliminate the "control battery replacement" issue.

To inventor's best knowledge, Cessac's invention is not known in the industry and has not enjoyed commercial success. Cessac did not document any cost savings expected of a temperature controlled methanol injection system.

The instant invention avoids the above Cessac drawbacks. The instant invention, of a temperature controlled electric pump, likely a "solar pump" for remote locations, yields a synergistic enhancement of solar pump reliability with methanol cost savings, which justifies the use of an expensive solar battery system, when needed.

Having completed the invention applicable to the paradigmatic methanol injection need, the need to inject methanol at remote or largely unmanned sites, it became clear that the invention has application in any electric pump system. Automatic control of an electric pump with an ambient temperature sensor at manned sites is likely to be more cost effective than manual human control.

THE INVENTION

The instant invention discloses a combination of an electrically powered pump, and in particular a "solar pump," together with an electric temperature controller (temperature sensor and switch,) for methanol injection service. The combination is more reliable and cost effective than a solar pump alone and more cost effective than a pneumatic pump alone.

The invention combines a temperature sensor and an on/off switch, directly or indirectly, in a line affecting electric communication between an electric source and a chemical injection pump. The sensor and switch are adapted to automatically start and stop, or adjust, the injection of methanol as a function of at least sensed temperature, such as sensed ambient temperature, and a selected setpoint. To enhance power conservation, a "self powered" temperature sensor and switch combination can be used.

The instant invention particularly relates to the tough case of remote, largely unmanned methanol injection systems for oil and gas production streams. The source of electric pump power there is preferably (or necessarily) provided by a solar rechargeable battery system. Studies indicate that a trigger based on ambient temperature, a trigger with a wide range of potential setpoints, is sufficient to generate surprising savings in methanol use, in pump use and in battery life, vis-à-vis the historic continuous "on" system for a winter season. The methanol savings alone may pay for the cost of the apparatus in a year.

Adjusting the times or amount of methanol injection, of course, can also be based on additional parameters, or other data. Sensing the temperature of oil and gas production streams, or of the production stream pipeline, or of additional elements, could enhance the savings and/or offer alternate or additional trigger factors.

The invention includes a method for injecting methanol appropriate for remotely located, largely unmanned oil and gas production streams. Given a placing of a source of methanol in fluid communication with an oil and gas stream, the method includes injecting methanol into the oil and gas production stream using an electrically powered pump, and adjusting the pump injection in accordance with a switch connected to, directly or indirectly, and in some embodiments powered by, a temperature sensor, such that the system is adapted to automatically adjust the injection as a function of sensed temperature and a temperature limit. The switch may effectively have one set point, such that the pump is off above the set point and on below the set point.

In regard to recharging a battery that provides electric pump power at remote locations, the recharging of the battery could be through solar energy and/or wind energy. Chemical injection pumps that operate off of a solar-energized, rechargeable battery are already available.

SUMMARY OF THE DEVELOPMENT

A surprising study regarding the extent of the waste of methanol and money associated with the popular always "on" "winter season" methanol injection methodology, challenged the inventors to add temperature control to a methanol injection pump to save methanol while continuing to satisfy the industry goals of: "relatively low cost of a system for reliably injecting." The combination is particularly applicable for operation at remote, largely unmanned locations, but once developed, clearly has benefit for manned locations and electric pumps.

The industry standard chemical injection pump for methanol injection service has been the "pneumatic" injection pump, for low cost and reliability reasons. Pneumatic injection pumps have proven particularly reliable for methanol operations at remote, largely unmanned oil and gas production locations. Pneumatic pumps siphon off gas or fluid from the pipeline being controlled to reliably power the pump.

Traditionally the chemical injection pump for methanol service is set, manually, to either "on" or "off," and run continuously "on" during the "winter season" while turned "off" for the summer season. The "winter season" could be defined as all of the days, plus those in between, in which experience has shown that the temperature might drop below a selected ambient temperature limit, selected for the given production location and oil and/or gas flow.

"Solar" injection pumps are battery powered injection pumps with batteries that are solar rechargeable. The development of solar pumps was driven by environmental concerns, as solar pumps do not vent gas into the atmosphere. Use of solar pumps for methanol service, however, raised significant reliability issues. The very weather that can significantly affect the ability to recharge can cause the greatest need for methanol. Further, while reliable pneumatic pumps cost approximately $500 to $700, solar pumps of questionable reliability for methanol service cost approximately $2,500. Because of the cost and reliability concerns, solar pumps have not been largely used for methanol injection.

As per Applicants' current best knowledge, only one entity, Cessac, has taught adding temperature control to a methanol injection pump in order to save methanol. That pump was a pneumatic pump. Addressing the goal of providing a "relatively low cost of a system for reliably injecting," Cessac taught a combination of a temperature controller with a standard pneumatic injection pump. This invention has not enjoyed commercial success. There is no indication that Cessac taught or appreciated the cost savings from a temperature controller added to a methanol injection pump. Indications are rather to the contrary. Cessac never discussed the feasibility of a solar rechargeable battery for his control motor, for instance, which could have eliminated his waste of methanol caused by his on/off temperature spread and the aggravation of having to replace control motor batteries. There is also no indication that solar pump manufacturers appreciated that a significant cost savings was possible with a solar pump for methanol injection service at remote locations, nor that a temperature controller added to a solar injection pump would increase the reliability of the solar based system, which is crucial in the methanol context, as well as lower net cost. Clear data justifying significantly lower net cost, essentially independently of a selected ambient temperature limit, is data that the inventors developed, data not known in the industry.

The instant inventors, to the contrary of Cessac and the industry, and as a result of their study, teach and disclose the surprising value of adding a temperature controller to an electric pump, and including a solar injection pump, for methanol injection service, the surprising value being in terms of cost savings and reliability.

In contrast to the high cost and suspected low reliability of a solar pump per se, impediments to its use in methanol service, the instant inventors document the surprising extent of the savings to be expected from adding a temperature controller to a solar injection pump used for methanol injection, more or less independently of a selected ambient temperature setpoint, and teach as well the enhanced reliability of the combination. The results of the methanol savings study were stunning to the inventors as well as to co-workers and partners. It could not have been predicted, in particular, that a combination of a temperature controller and a solar pump could synergistically provide a "relatively low cost system for reliably injecting" methanol. The context of "relatively low cost" was not predictable prior to the inventors' studies, nor had the enhanced reliability been taught.

SUMMARY OF THE INVENTION

The invention includes a methanol injection system for an oil and/or gas stream, having a source of methanol connected through an injection pump to the stream and comprising a temperature sensor connected directly or indirectly to a switch connected directly or indirectly to a line of electric power running to a motor powering the pump. At least one selectable temperature setpoint together with the sensor and the switch are structured in combination to control, at least in part, motor power to the pump as a function of sensed temperature and selected setpoint. The temperature sensor and switch may be a self powered switch that includes a gas filled temperature sensor. The electric power may include a battery and in fact a solar rechargeable battery. The temperature sensor is preferably located to sense ambient temperature, directly or indirectly.

Alternately viewed, the invention includes a methanol injection system for remote oil and/or gas production streams comprising an electric chemical injection pump connected by a power line to a source of electricity. The invention includes a power switching system including a switch connected in the power line and structured to adjust power through the power line as a function of a temperature sensor and a selectable setpoint, the sensor and setpoint connected directly or indirectly to the power switch.

The invention also includes an improved system for injecting methanol with a pump into an oil and/or gas production stream at a remote site comprising an electric motor, a source of electricity, a temperature sensor, a switch and a temperature setpoint. The motor, source, sensor, switch and setpoint are connected in combination to selectively power the pump as a function of sensed temperature and a setpoint setting.

The invention includes a method for cost effectively injecting methanol into an oil and/or gas production stream comprising placing an electric motor and an injection pump in communication with a source of methanol and an oil and/or gas production stream. The method includes placing a temperature sensor and switch, directly or indirectly, in a line of electrical communication between a source of electric power and electric pump and selecting at least one temperature setpoint for adjusting, by the switch, injection of methanol into the production stream as a function of sensed temperature.

The invention also includes an improved method for methanol injection into an oil and/or gas production stream at a remote site, comprising powering the pump for methanol injection with an electric motor connected directly or indirectly to a temperature sensor, a switch and a selectable temperature setpoint. The invention also includes selecting a temperature setpoint for a winter season at a remote site such that the pump is powered on less than 75% of the season.

BRIEF DESCRIPTION OF THE DRAWINGS

A better understanding of the present invention can be obtained when the following detailed description of the preferred embodiments are considered in conjunction with the following drawings, in which.

Figure 1:
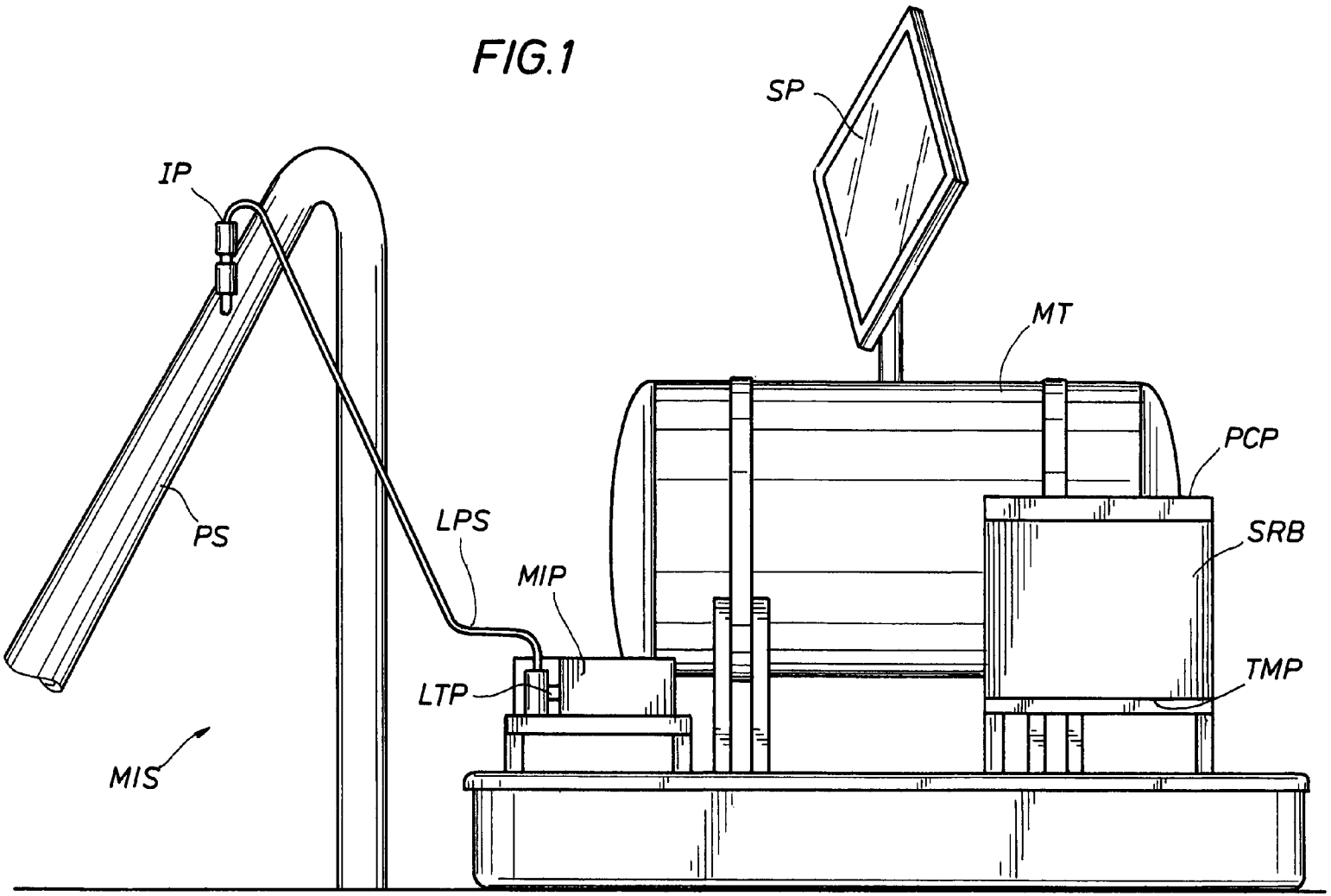
FIG. 1 provides a view of a preferred initial embodiment of a methanol injection system with an indication of the placement of a temperature sensor and a solar battery system.

The drawings are primarily illustrative. It would be understood that structure may have been simplified and details omitted in order to convey certain aspects of the invention. Scale may be sacrificed to clarity.

DETAILED DESCRIPTION OF PREFERRED EMBODIMENTS

The phrase "oil and gas" as used herein should be understood to mean oil and/or gas and the like, as known in the art. Production stream is used herein to indicate a stream of hydrocarbons and water, including gas and liquid, as exemplified by gas, water and/or oil produced from the earth. "Pump" as sometimes used herein impliedly includes the pump motor, a common usage in the art.

Independent producers of oil and gas pump raw product, typically from remote locations, to common gathering stations. The communication pipelines are subject to ambient weather and temperature conditions. Provision must be made that the product does not freeze in the pipeline and/or that the product maintains acceptable flow characteristics. It is industry custom to inject methanol into the product and/or pipeline at the locations to combat any tendency to freeze or not to flow well.

Many of the locations for the production oil and/or gas are remote and largely unmanned, or minimally manned. As a consequence, the pumps that add the requisite amount of methanol to the oil and gas, in order to reliably ensure that the product does not freeze or flow too slowly in the pipeline, are set "on" or "off" for extended periods of time, e.g. for a "winter season," based on experience with the local temperature and the product. A typical scenario might require that methanol be pumped or injected into the pipeline from October 15 to April 15, given the historic experience with the product, the location and the temperature. From April 15 to October 15 the assumption would be that the temperature is high enough that there is no probability of freezing or slow flowing of the product in the line, and thus no methanol need be injected. Thus, because of the typical remote largely unmanned location, chemical injection pumps to inject methanol into oil and/or gas transportation pipelines are traditionally set "on" for a "winter season" and otherwise "off". The setting is manually changed.

The instant inventors tested the cost efficiency of the manual set-on/set-off methanol injection control system vis-à-vis a postulated automated temperature controlled methanol injection system, such as a switch that turns a pump on and off as a function of sensed ambient temperature and a selected setpoint or trigger. The inventors collected a year's worth of temperature data, hour by hour, from a North Texas location. The results of the study surprisingly indicated that a simple ambient temperature trigger, whether set at 60 degrees, 50 degrees or 40 degrees, could save approximately 40%, 65% or 80%, respectively, of the operating time and methanol expended, during a winter season, as compared to a historic manually set-on/set-off system.

Initial Temperature Study

Dallas, Tex. was selected as a location for the first hypothetical oil and gas production test study. A history of temperature, hour by hour, was collected for Dallas, Tex., for a year, the year of 2008. See Table I, included in co-pending provisional application 61/278,895 incorporated by reference herein, pages 1-259. (Due to their extensiveness, Tables I and II are not repeated herein.) Assuming that a remote operator of an oil and gas facility was inherently familiar with temperature variations at the location, the inventor estimated, based on the data, when that operator would turn the injection pump on and leave it on (either October 15 or November 15) and when that operator would consider it safe to turn the methanol injection pump off and leave it off, (either April 15 or March 15). That is, the operator was given the benefit of hindsight, reflecting an assumption that an experienced operator in the Dallas location would have an instinctive and accurate sense of the hour by hour temperature variations at his location over a year. The operator was deemed not to err by letting the pipe freeze.

The instant inventors then selected a plurality of potential turn off/turn on ambient temperature triggers, or setpoints, that an operator might adopt for the instant invention system, taking into account a conservative inclination and allowing for various margins of safety. The instant inventors then ran an analysis of the historic versus the inventive system, based upon a 60 degree turn on/turn off trigger, a 50 degree turn on/turn off trigger and a 40 degree turn on/turn off trigger and upon two different "winter season" estimations.

The results of the surprisingly study show that for even a very conservative 60 degree turn on/turn off temperature trigger, a simple ambient temperature switch should yield a savings of approximately 40% of pump time and methanol use for the year. At a more risky 40 degree turn on/turn off ambient temperature trigger, the savings surprisingly rose to approximately 80%. Thus, the utility of even a simple ambient temperature turn on/turn off switch for a remote methanol injection system appeared clear, although surprising to those in the industry.

Alternate embodiments of the instant invention could include sensing a variety of temperatures and utilizing a plurality of sensed data in a more complex "controller" system in order to generate a switching and/or controlling system that is even more tailored and cost effective.

A further feature of the instant system is that the temperature sensor and switch itself can require no separate or extra power. An electric switch/temperature sensor combination can operate off of the motive force provided by temperature change. Said otherwise, a temperature sensor/electric switch combination can be "self powered" by using a gas filled temperature switch.

FIG. 1 is a representation of a first preferred embodiment of the instant methanol injection system MIS offering an indication of location TMP for a temperature sensor and switch, in communication with a solar rechargeable battery SRB and electric methanol injection pump MIP. The injection system MIS, as indicated, can include a methanol tank MT, an injection pump MIP with electric motor, a battery source SRB of electric power for the motor with a solar power recharge system SP for the batteries SRB, lines running from the methanol tank to the injection pump LTP and lines LPS running from the pump to the injection point IP adjacent the production stream pipeline PS. The production stream runs through a pipe PS coming up from the ground and turning laterally to the left, in the figure, and under the injection point IP. The injection point IP typically includes valves such as a manual on/off valve and a check valve. A methanol source MT and pump controller PCP are indicated. A location TMP for the temperature sensor and the switch is indicated for the system. A preferred ambient temperature measuring point was selected underneath the pump control panel PCP and battery SRB compartment. The electric switch TSW connects between the pump and the pump control panel PCP, or in the pump central panel, to add on/off capability.

Figure 2:
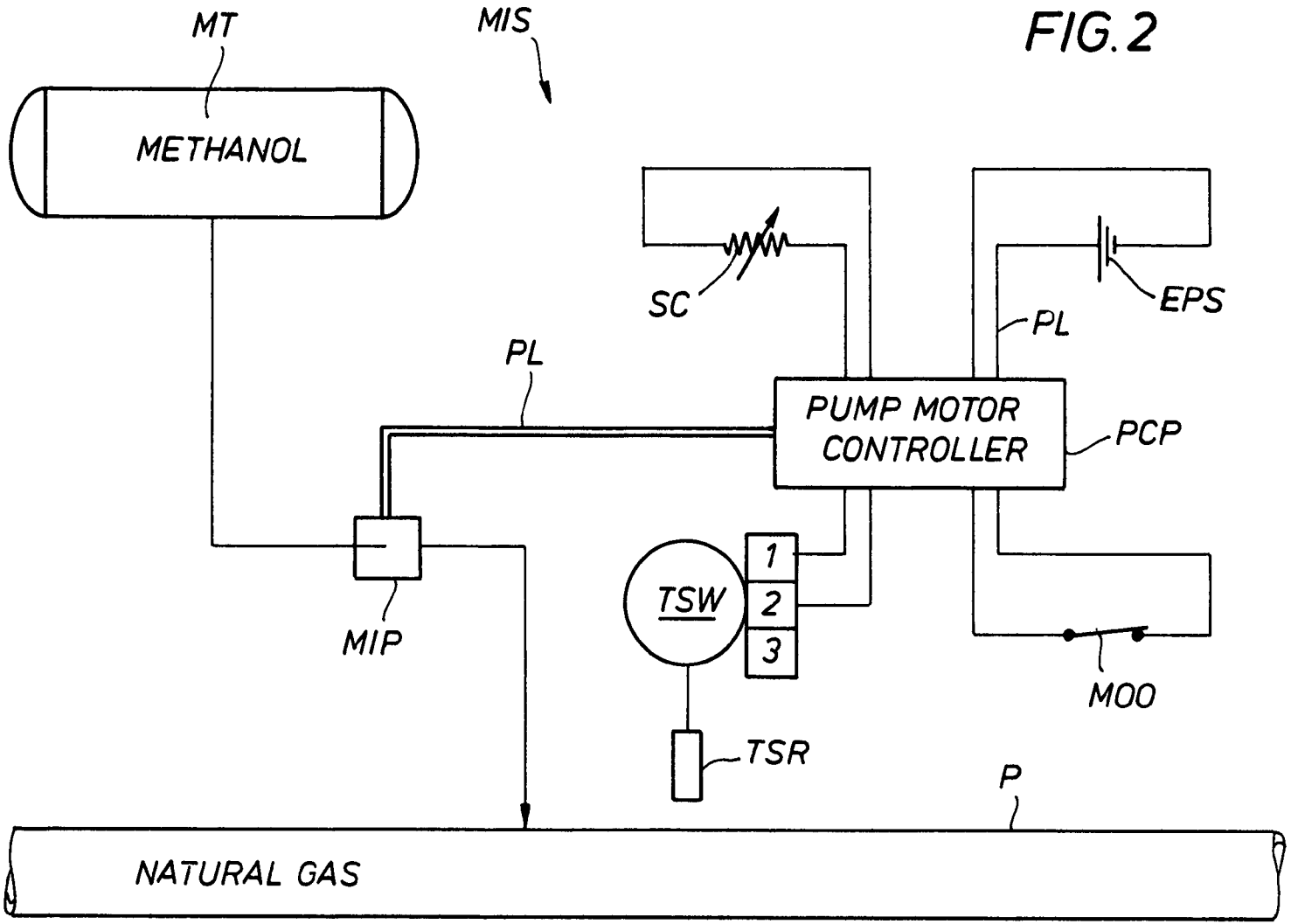
FIG. 2 illustrates structure of a preferred embodiment for the methanol injection system.
Figure 3A:
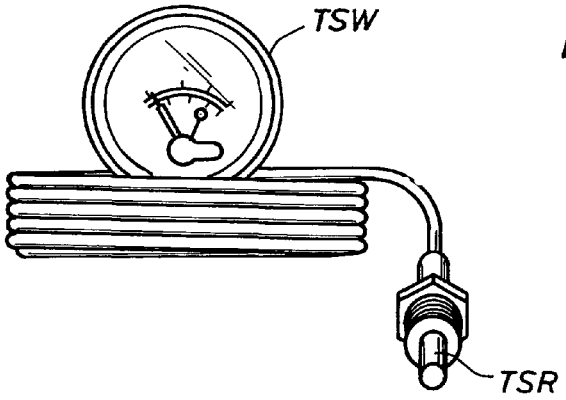
FIGS. 3A and 3B illustrate a preferred embodiment of a temperature sensor and switch, in combination, used in the initial embodiment.
Figure 3B:
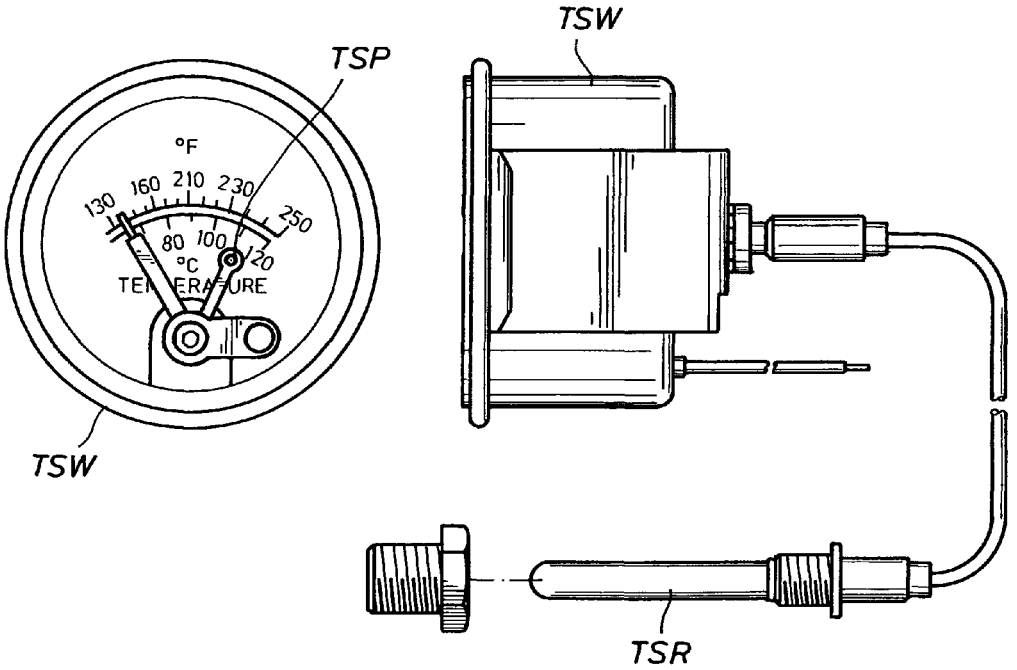

The preferred embodiment used a Murphy Instruments model 20T indicating/adjustable temperature switch TSR/TSW, as indicated in FIGS. 3A and 3B herein. (Catalogue pages for the Murphy Instrument switch are attached as FIGS. 2A through 2D to the above referenced co-pending provisional application, incorporated by reference.)

FIG. 2 herein is a schematic illustration of a preferred embodiment. Methanol tank MT is connected through electrical chemical pump MIP to inject methanol into natural gas line PS. The pump operates off of electrical power source EPS. The electrical power source typically includes a manual on/off switch MOO. Also typically, the electrical power source is controlled by a pump motor controller PCP. Frequently methanol injection pumps include pump speed controllers SC. In such embodiment the pump motor controller PCP controls the chemical pump speed control SC. The temperature switch TSW is connected between the electrical power source and the chemical pump (possibly integrated into the pump motor controller or relay) so as to directly or indirectly open and close a circuit between the electrical power source and the chemical pump. In a typical case a connection between the temperature switch and the electrical power source and chemical pump would be made through the pump motor controller PCP, or relay. Alternately the switch could be in a direct electric line.

FIGS. 3A and 3B illustrate a Murphy Instruments model TNT temperature sensor TSR and temperature switch TSW. FIG. 3B illustrates the connection between the gas filled sensing bulb and the temperature switch compartment. The temperature switch in the Murphy 22 series will have at least one setpoint. When the dial, moved by the force of gas from the sensing bulb, passes within sufficient proximity to the setpoint, an electrical connection is made within the temperature switch.

It should be understood that the electric pump of the instant invention may be any of several varieties utilized for injection pumps and electric motors. The pump could be a variable speed pump where a motor controller varies the speed of the pump in order to vary the amount of methanol injected. The pump could be a constant speed variable timing pump where a pump motor controller varies the on service duty cycle of the pump so as to control the amount injected. The pump could be a variable displacement pump, with either constant speed or variable speed or variable timing.

Typically an injection pump will utilize a motor purchased from a standard motor manufacturer. Almost all motors come with a pump motor controller. The pump motor controller is typically a circuit board but could be any other type of electronic processor. Typically the pump motor controller contains input output ports. As illustrated in FIG. 2, one set of ports could provide for inputting power from the electrical power source. One set of a ports could provide for a manual on/off switch. One set of ports could provide for alternate on/off switches such as for the instant temperature sensor/switch. One set of ports could provide for communication of electric power to the motor and pump It is conceivable that the instant invention could operate with a pump with no pump motor controller. In such case the switch of the instant temperature sensor and switch combination would be placed in a line of direct communication of elective power between the source and the pump.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A methanol injection system for remotely located oil and/or gas stream, having a source of methanol connected through an injection pump to the stream, comprising:

a temperature sensor connected directly or indirectly to a switch connected directly or indirectly to a line of electric power running to a motor powering the pump;

at least one selectable temperature setpoint; and the sensor, the switch and the setpoint structured in combination to control, at least in part, motor power to the pump as a function of sensed temperature and selected setpoint and wherein the temperature sensor and switch are connected together as a self-powered switch and which includes a gas filled temperature sensor.

2. The system of claim 1 wherein the methanol injection motor includes a motor controller and wherein the switch communicates with or within the motor controller.

3. The system of claim 1 wherein the oil and/or gas stream is remotely located.

4. The system of claim 1 wherein the switch is installed directly in a line of electric power running to the pump.

5. The system of claim 1 wherein the electric power includes a battery.

6. The system of claim 5 wherein the battery includes at a solar rechargeable battery.

7. The system of claim 1 wherein the temperature sensor is located to sense ambient temperature, directly or indirectly.

8. A methanol injection system for remote oil and/or gas production streams, comprising:

an electric chemical injection pump connected by a power line to a source of electricity; and a power switching system including a switch connected in the power line and structured as a self-powered switch to adjust power through the power line as a function of a gas filled temperature sensor and a selectable setpoint, the sensor and setpoint connected directly or indirectly to the power switch.

9. An improved system for injecting methanol with a pump into an oil and/or gas production stream at a remote site, comprising:

an electric motor, a source of electricity, a gas filled temperature sensor, a switch and a temperature set point, the motor, source, sensor, switch and setpoint connected in combination to provide a self-powered switch to selectively power the pump as a function of a sensed temperature and a set point setting.

10. A method for cost effectively injecting methanol into an oil and/or gas production streams, comprising:

placing an electric motor and injection pump in communication with a source of methanol and an oil and/or gas production stream;

placing a temperature sensor and switch, directly or indirectly, in a line of electrical communication between a source of electric power and the electric motor; and selecting at least one temperature setpoint for a winter season for adjusting, by the switch, injection of methanol into the production stream as a function of sensed temperature such that the pump is powered on less than 75% of the season.

11. The method of claim 10 wherein the source of electric power includes a solar rechargeable battery.

12. The method of claim 10 wherein sensed temperature includes ambient temperature.

13. The method of claim 10 wherein the temperature sensor and switch includes a gas filled temperature switch.

14. The method of claim 10 that includes placing the temperature sensor in communication with a motor controller of the electric motor and placing the electric switch in contact with or within the motor controller.

15. The method of claim 10 wherein the oil and/or gas production stream is remotely located.

* * * * *